US011292556B2

(12) United States Patent
Kinjo

(10) Patent No.: US 11,292,556 B2
(45) Date of Patent: Apr. 5, 2022

(54) MOORING ANCHOR

(71) Applicant: Environmental Resource Development Consultant Corporation, Osaka (JP)

(72) Inventor: Giei Kinjo, Osaka (JP)

(73) Assignee: Environmental Resource Development Consultant Corporation, Osaka (JP)

( * ) Notice: Subject to any disclaimer, the term of this patent is extended or adjusted under 35 U.S.C. 154(b) by 0 days.

(21) Appl. No.: 17/021,610

(22) Filed: Sep. 15, 2020

(65) Prior Publication Data

US 2020/0407022 A1 Dec. 31, 2020

Related U.S. Application Data

(63) Continuation of application No. PCT/JP2018/010250, filed on Mar. 15, 2018.

(51) Int. Cl.
*B63B 21/04* (2006.01)
*B63B 21/26* (2006.01)

(52) U.S. Cl.
CPC ..... *B63B 21/26* (2013.01); *B63B 21/04* (2013.01)

(58) Field of Classification Search
CPC ..... B63B 21/04; B63B 21/26; B63B 21/50
See application file for complete search history.

(56) References Cited

U.S. PATENT DOCUMENTS 6,457,908 B1 * 10/2002 Bergeron ..... B63B 21/04 114/230.1
6,685,396 B1 * 2/2004 Bergeron ..... B63B 21/04 114/296
2011/0154636 A1 * 6/2011 Smith ..... B63B 21/26 29/428
2020/0130782 A1 * 4/2020 Smith ..... B63B 21/50
(Continued)

FOREIGN PATENT DOCUMENTS

CA 1011565 A 6/1977
CN 2492460 Y 5/2002
CN 2736251 Y 10/2005
(Continued)

OTHER PUBLICATIONS

Office Action issued in Chinese Patent Application No. 201880090434.1 dated Nov. 2, 2021 with English Translation (12 pages).
(Continued)

*Primary Examiner* — S. Joseph Morano
*Assistant Examiner* — Jovon E Hayes
(74) *Attorney, Agent, or Firm* — Nakanishi IP Associates, LLC

(57) ABSTRACT

For firm installation at a water bottom, a mooring anchor for securing a basal end of a mooring line underwater includes an anchor assembly to which the mooring line is to be fastened, and installable at a water bottom, and a guide to be secured at the water bottom at a position away from the anchor assembly and including a holder to receive and hold the mooring line in a movable manner. The anchor assembly
(Continued)

11···Mooring anchor
13···Mooring line
13a···Basal end
14···Water bottom
31··· Anchor assembly
32··· Pile
33··· Tilted support
41··· Pressure receiving plate
51··· Guide
52··· Holder includes a pile drivable into the water bottom and a tilted support extending obliquely downward toward the guide at the water bottom and to be embedded in the water bottom, such that the tilted support withstands and overcomes a tensile force acting in a horizontal direction.

5 Claims, 8 Drawing Sheets

(56) References Cited

U.S. PATENT DOCUMENTS

| | | | | | |
|---|---|---|---|---|---|
| 2020/0407022 | A1 * | 12/2020 | Kinjo | ..... | B63B 21/26 |

FOREIGN PATENT DOCUMENTS

| | | | | | |
|---|---|---|---|---|---|
| CN | 1882472 | A | | 12/2006 | |
| CN | 101886400 | A | | 11/2010 | |
| CN | 103052561 | A | | 4/2013 | |
| CN | 20462200 | U | | 9/2017 | |
| JP | 58-126279 | | * | 7/1983 | ..... B63B 21/50 |
| JP | S58-126279 | A | | 7/1983 | |
| JP | S60-108598 | U | | 7/1985 | |
| JP | S60-192018 | A | | 9/1985 | |
| JP | 2002-211480 | A | | 7/2002 | |
| JP | 2016-113123 | A | | 6/2016 | |
| JP | 2016113123 | | * | 6/2016 | ..... Y02E 10/50 |
| KR | 10-2015-0055727 | A | | 5/2015 | |
| WO | 2005-108198 | A1 | | 11/2005 | |
| WO | 2019/176057 | A1 | | 9/2019 | |
| WO | WO-2019176057 | A1 | * | 9/2019 | ..... B63B 21/26 |

OTHER PUBLICATIONS

International Search Report issued in PCT/JP2018/010250 dated Apr. 17, 2018 with English Translation (5 pages).

Office Action issued in Japanese Patent Application No. 2019-111667 dated Jul. 9, 2019 with English Translation (4 pages).

Office Action issued in Taiwanese Patent Application No. 107122172 dated Oct. 1, 2021 (8 pages).

* cited by examiner

MOORING ANCHOR

CROSS-REFERENCE TO RELATED APPLICATIONS

This application is a continuation application of International Patent Application No. PCT/JP2018/010250 filed on Mar. 15, 2018, the entire content of which is incorporated by reference.

BACKGROUND OF INVENTION

Field of the Invention

The present invention relates to a mooring anchor for a mooring target such as a floating photovoltaic power system, an aquaculture cage, a floating pier, or a water sports facility for, for example, canoeing.

Background Art

Mooring anchors are typically heavy objects such as concrete blocks. Many anchors, each fastened to a basal end of a mooring line, are installed at the water bottom to surround the mooring position of a mooring target. The anchors, located near the mooring target, mainly receive upward tensile forces when the mooring target moves on the water surface. Thus, the anchors are installed to have sufficiently high tensile resistance.

Further, anchors located near a mooring target with short mooring lines are less responsive to changes in the water level, and also can have the mooring lines under rapidly increasing tensile forces when the mooring target moves. The mooring lines or the mooring target may receive strong impact, or the mooring lines may be broken.

To avoid impact on or breakage of a mooring line, a structure described in Patent Literature 1 includes a sinker as a heavy object between an anchor and a mooring target.

However, the sinker moves upward when the mooring line is pulled. The anchor is to be secured with sufficiently high tensile resistance. Also, the water bottom has varying profiles. Fastening the anchor with sufficiently high tensile resistance is difficult in various water bottom environments.

CITATION LIST

Patent Literature

Patent Literature 1: Japanese Unexamined Patent Application Publication No. 2002-211480

SUMMARY OF INVENTION

Technical Problem

One or more aspects of the present invention are directed to firm installation of an anchor without relying on tensile resistance against an upward tensile force.

Solution to Problem

A mooring anchor according to an aspect of the present invention is a mooring anchor for securing a basal end of a mooring line underwater. The mooring anchor includes an anchor assembly to which the mooring line is to be fastened, and installable at a water bottom, and a guide to be secured at the water bottom at a position away from the anchor assembly. The guide includes a holder to receive and hold the mooring line in a movable manner. The anchor assembly includes a pile drivable into the water bottom and a tilted support extending obliquely downward toward the guide at the water bottom and to be embedded in the water bottom.

This structure includes the guide that guides the mooring line having the basal end fastened to the anchor assembly along the water bottom, and holds the mooring line near the water bottom in a movable manner. When the mooring line is pulled, the anchor assembly remains installed with the pile against a tensile force. The anchor assembly in this state is thus supported by the tilted support extending in the same direction as the mooring line in the water bottom.

Advantageous Effects

The mooring anchor according to the above aspect of the present invention allows the tilted support to withstand and overcome a tensile force applied to the anchor assembly along the water bottom, thus enabling firm installation of the anchor assembly without relying on tensile resistance against an upward tensile force.

DETAILED DESCRIPTION

Figure 1:
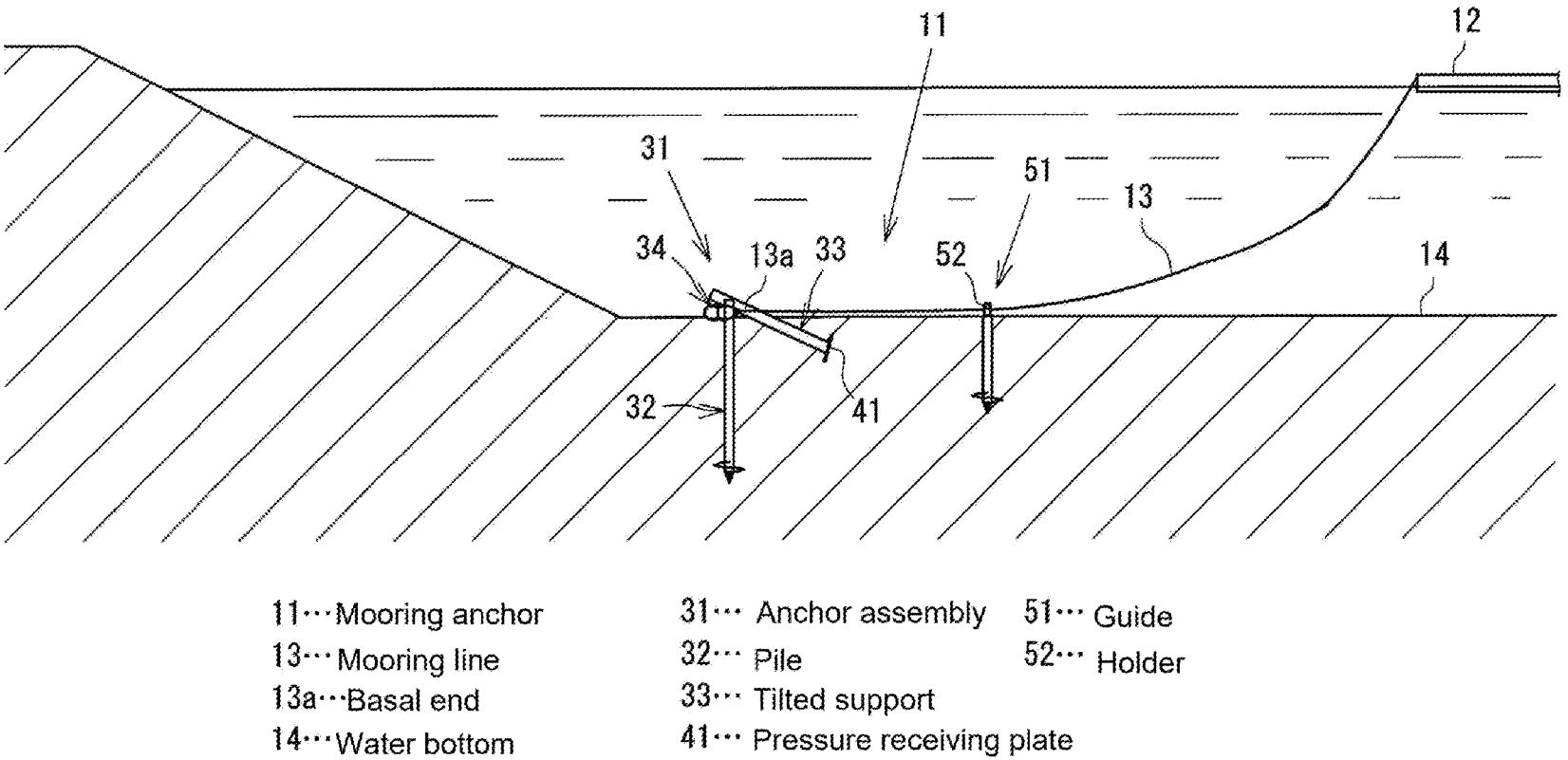
FIG. 1 is a side view of a mooring target moored by a mooring anchor.

FIG. 1 is a view of a mooring target 12 moored by a mooring anchor 11. The mooring anchor 11 secures a basal end 13*a* of a mooring line 13 underwater. The mooring line 13 has a free end connected to the mooring target 12. The mooring line 13 may be formed from an appropriate material, such as a wire rope. In the illustrated example, the mooring target 12 is a floating platform on which a photovoltaic power system (not shown) is mounted. The mooring target 12 floats on the water surface of, for example, an irrigation reservoir and other reservoirs, a fishpond, and a lake.

The mooring anchor 11 includes an anchor assembly 31 and a guide 51. The anchor assembly 31 is installed at a water bottom 14. The mooring line 13 is fastened to the anchor assembly 31. The guide 51 is secured at the water bottom 14 at a position away from the anchor assembly 31. The mooring line 13 is placed through the guide 51 and is held in a movable manner. The secured position of the guide 51 is away from the anchor assembly 31 toward the mooring position of the mooring target 12. The distance between the anchor assembly 31 and the guide 51 is adjusted in accordance with the installation environment to, for example, about a few to ten meters. The mooring line 13 connecting the anchor assembly 31 to the mooring target 12 through the guide 51 may be long.

Figure 2:
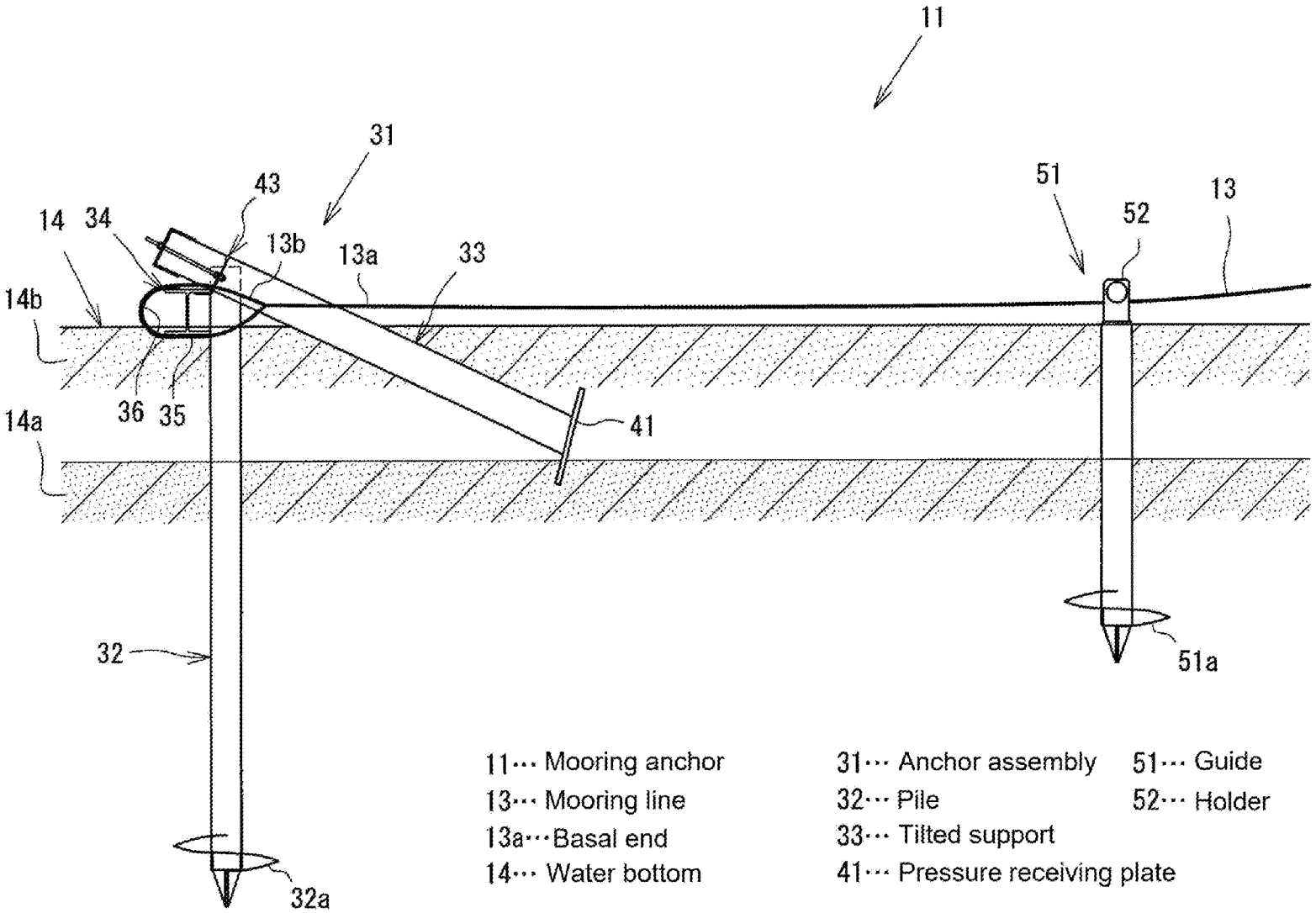
FIG. 2 is a side view of the mooring anchor installed.
Figure 3:
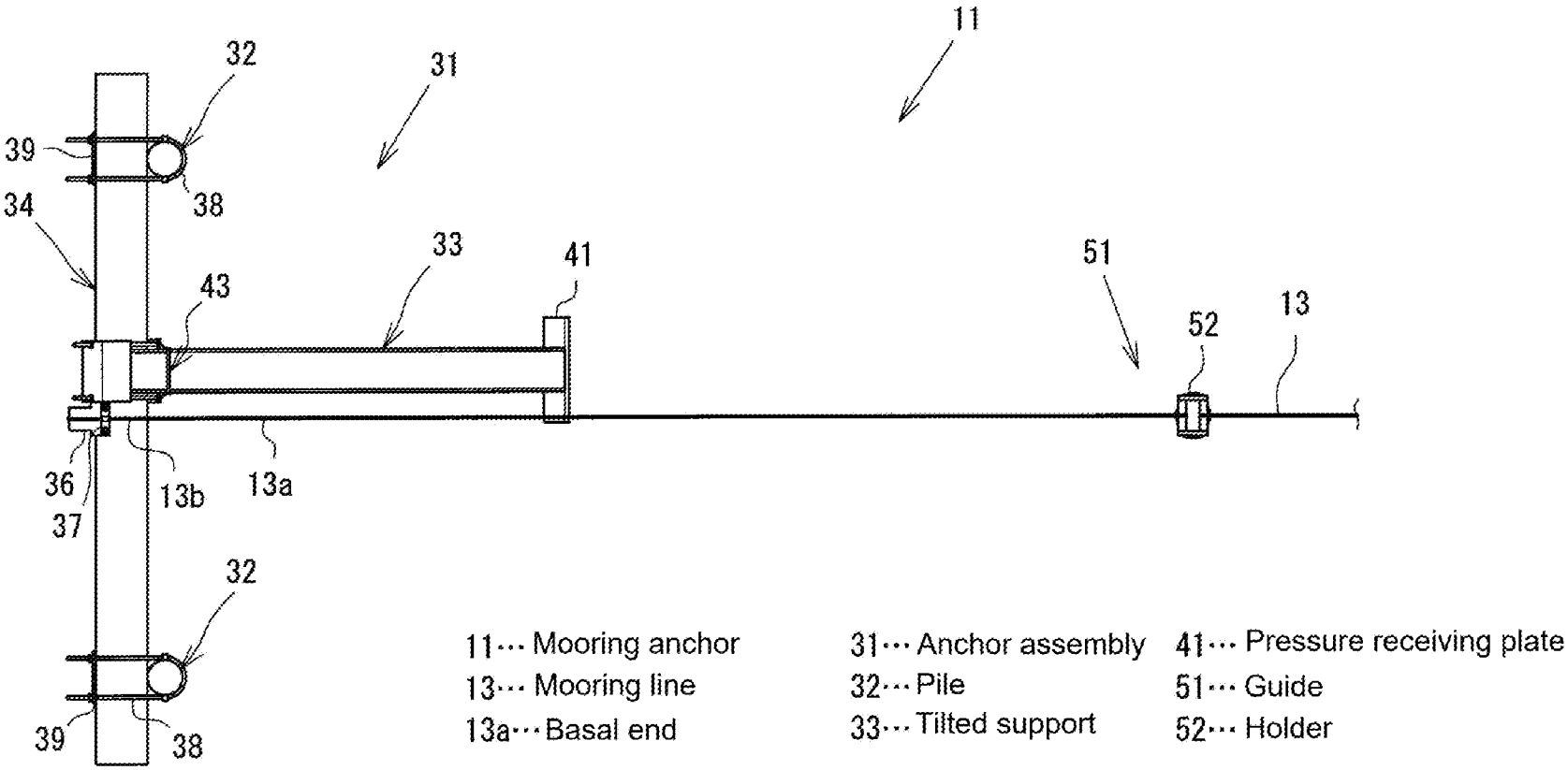
FIG. 3 is a plan view of the mooring anchor installed.

FIG. 2 is a side view of the mooring anchor 11 installed, showing a main part. FIG. 3 is a plan view of the mooring anchor 11 installed. As shown in these figures, the anchor assembly 31 includes piles 32 and a tilted support 33. The piles 32 are driven into the water bottom 14. The tilted support 33 extends obliquely downward toward the guide 51 at the water bottom 14 and is embedded in the water bottom 14.

More specifically, the anchor assembly 31 includes a bar anchoring part 34, which is sunk to the water bottom 14 and to which the mooring line 13 is fastened, in addition to the piles 32 integral with the anchoring part 34 and the tilted support 33 integral with the anchoring part 34.

The anchoring part 34 is formed from steel. The anchoring part 34 has a ground contact surface 35 in contact with the water bottom 14. The anchoring part 34 may be formed from H-beam steel. The anchoring part 34 formed from H-beam steel is installed to have two parallel flanges being the upper and lower surfaces when in use. The length of the anchoring part 34 is set as appropriate to, for example, about a few meters when the anchoring part 34 has one pile 32 on each of the two ends in the longitudinal direction.

Figure 4:
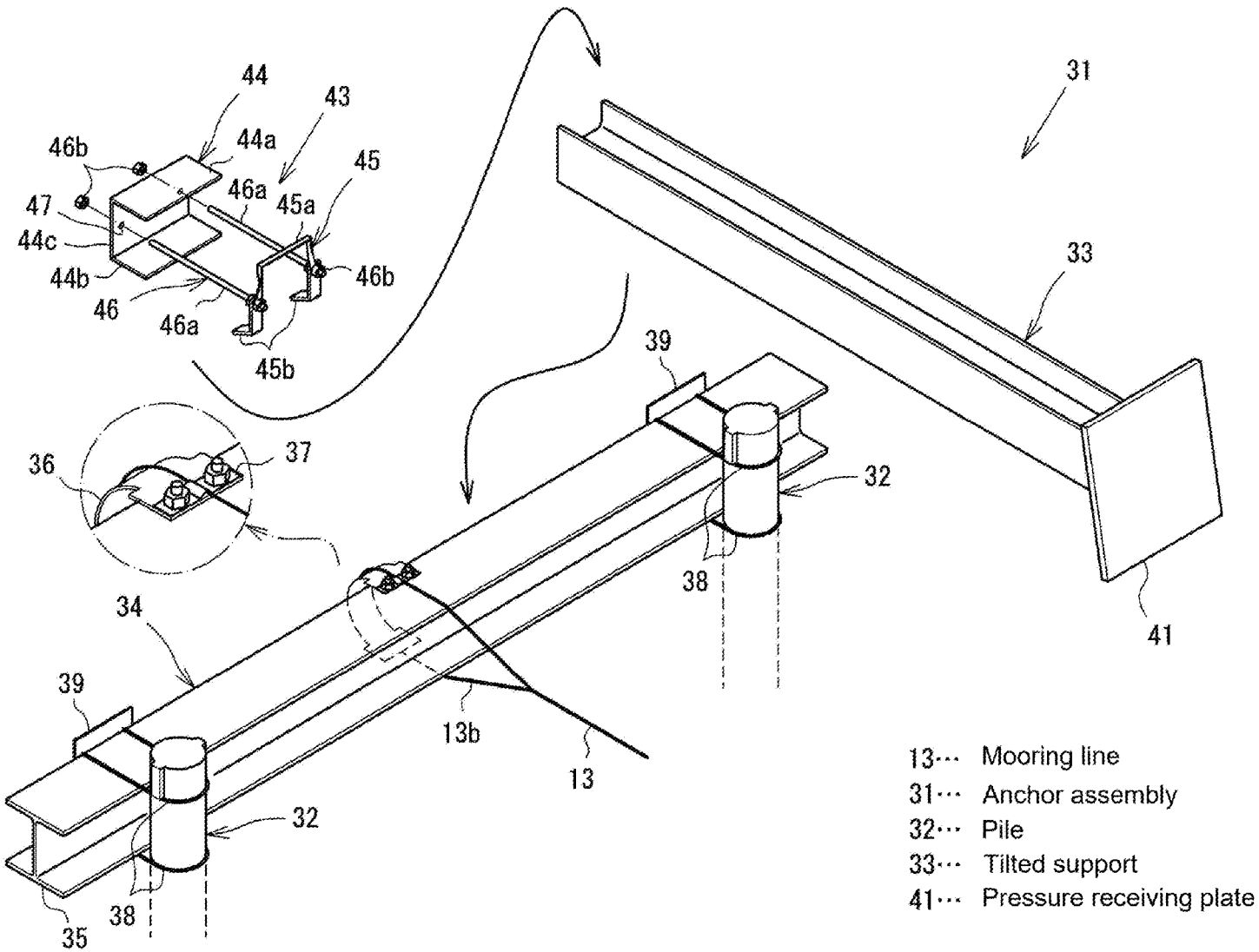
FIG. 4 is an exploded perspective view of an anchor assembly.

The basal end 13*a* of the mooring line 13 is fastened to a middle portion of the anchoring part 34 in the longitudinal direction. In the illustrated example, the mooring line 13 has, at the basal end 13*a*, an annular portion 13*b* wound around and hooked on the anchoring part 34. The mooring line 13 may be fastened in any other manner. As shown in FIG. 4, the anchoring part 34 formed from H-beam steel has a support plate 36 fastened to its surface opposite to a surface from which the mooring line 13 extends. The support plate 36 receives the annular portion 13*b* of the mooring line 13. The support plate 36 is substantially half-arc-shaped as viewed laterally. The support plate 36 has two ends on the upper and lower surfaces of the anchoring part 34, to which metal fittings 37 are fastened to hold the annular portion 13*b* of the mooring line 13 on the support plate 36.

Each pile 32 is a rod having a screw blade 32*a* at its tip. Each pile 32 is driven into the water bottom 14, and then the upper end is fastened to and integrated with a side surface of the anchoring part 34. The piles 32 are fastened to the side surface of the anchoring part 34 from which the mooring line 13 extends. As shown in FIG. 4, each pile 32 is fastened with U-bolts 38 and a fixing plate 39. The U-bolts 38 are on the upper and lower surfaces of the anchoring part 34. The fixing plate 39 is fastened at the two ends of each U-bolt 38 to hold the anchoring part 34 between the fixing plate 39 and the pile 32. Each pile 32 is long enough to be secured stably when its upper end is placed near the water bottom 14.

The tilted support 33 is a bar of steel with an appropriate length. The steel may be H-beam steel. The tilted support 33 formed from H-beam steel is installed to have two parallel flanges standing erect when in use.

The tilted support 33 formed from H-beam steel does not have a sufficiently large surface on its distal end to receive pressure. The tilted support 33 thus has, on its distal end, a pressure receiving plate 41 being flanged. The pressure receiving plate 41 is square and is appropriately sized. Although the pressure receiving plate 41 may have another shape and may be, for example, circular, the square pressure receiving plate 41 has corners at its periphery and can have a stable posture at the water bottom 14.

As described above, the tilted support 33 extends obliquely and is embedded in the water bottom 14. Thus, the pressure receiving plate 41 is tilted with respect to the longitudinal direction of the tilted support 33 depending on the angle at which the tilted support 33 is embedded.

More specifically, when the tilted support 33 is tilted at an angle of 15 to 30 degrees with respect to the horizontal direction, the pressure receiving plate 41 may be at an angle of 0 to 30 degrees with respect to the vertical direction. The tilted support 33 may be tilted at an angle of 20 to 25 degrees with respect to the horizontal direction, and the pressure receiving plate 41 may be at an angle of 10 to 15 degrees with respect to the vertical direction. Thus, the pressure receiving plate 41 is tilted at an angle of about 80 degrees, instead of 90 degrees, with respect to the tilted support 33.

The tilted support 33 is integrally coupled to the anchoring part 34 at a position adjacent to a portion of the anchoring part 34 to which the mooring line 13 is fastened with a metal coupler 43 shown in FIG. 4.

The metal coupler 43 includes a fitting 44, an engagement member 45, and a connector 46. The fitting 44 is fitted with a rear end of the tilted support 33. The engagement member 45 is engaged with an edge of an upper flange on the H-beam steel anchoring part 34 opposite to the ground contact surface 35. The connector 46 connects the fitting 44 and the engagement member 45.

The fitting 44 includes an upper plate 44*a* covering an upper surface of the tilted support 33, a lower plate 44*b* covering a lower surface of the tilted support 33, and a connecting plate 44*c* connecting the upper plate 44*a* and the lower plate 44*b*. When fitted with the rear end of the tilted support 33, the fitting 44 protrudes outward from two side surfaces of the tilted support 33.

The engagement member 45 includes a staple-shaped connecting part 45*a* and tabs 45*b*. The connecting part 45*a* covers, from above, and extends across the tilted support 33. The tabs 45*b* are located on the lower ends of the connecting part 45*a*. Each tab 45*b* is bent at an obtuse angle at the corresponding lower end of the connecting part 45*a* toward the fitting 44.

The connector 46 includes two bolts 46*a* and nuts 46*b* screwed with the bolts 46*a*. The bolts 46*a* are held above the tabs 45*b* on the engagement member 45 and have their distal ends received in through-holes 47 in two ends of the connecting plate 44*c* in the fitting 44.

Figure 5:
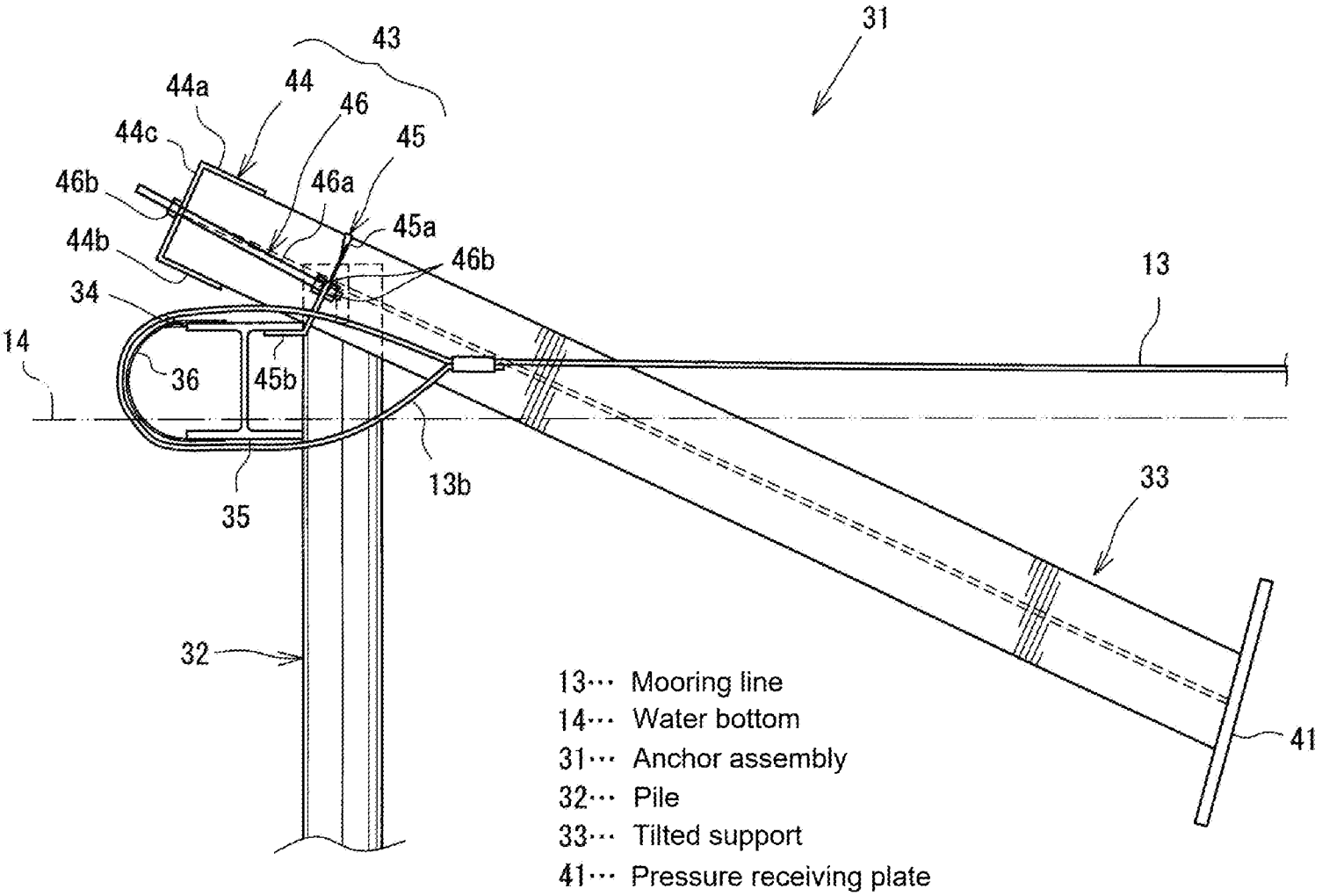
FIG. 5 is a side view of the anchor assembly showing a main part.

FIG. 5 is a side view of the tilted support 33 fastened to the anchoring part 34 with the metal coupler 43. As shown in the figure, the metal coupler 43 has the fitting 44 fitted with the rear end of the tilted support 33 and the engagement member 45 covering the tilted support 33 with the tabs 45*b* extending downward engaged with the edge of the upper flange on the anchoring part 34. The connector 46 fastens the fitting 44 and the engagement member 45 in this state to place them close to each other, thus firmly integrating the tilted support 33 with the anchoring part 34 and holding the tilted support 33 and the anchoring part 34 at a predetermined angle between them. In FIG. 5, the metal fitting 37 fastening the mooring line 13 to the anchoring part 34, the U-bolts 38, and the fixing plates 39 are not shown for ease of explanation.

Figure 6:
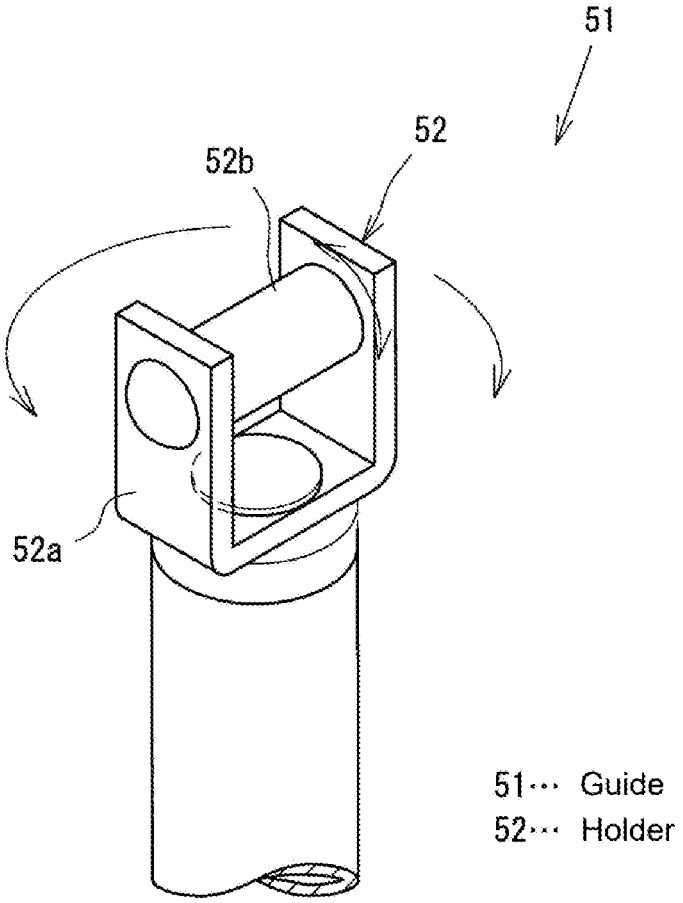
FIG. 6 is a perspective view of an upper end of a guide.

The guide 51 includes a pile member that is driven into the water bottom 14, similarly to the piles 32 described above. Thus, the guide 51 is a rod and has a screw blade 51*a* at its tip (refer to FIGS. 1 and 2). The guide 51 includes a holder 52 to receive and hold the mooring line 13 in a movable manner at an upper end at the water bottom 14 when the guide 51 is driven into the water bottom 14. As shown in FIG. 6, the holder 52 includes a holder frame 52*a* rotatable in the horizontal direction, or in other words, swingable, and a rotatable roller 52*b* fitted across the holder frame 52*a*. The space between the roller 52*b* and a base of the holder frame 52*a* is sized to receive the mooring line 13.

The mooring anchor 11 with the above structure is installed in the manner described below.

As shown in FIGS. 1 and 2, the anchoring part 34 in the anchor assembly 31 is placed at the water bottom 14 at a position away from the mooring position of the mooring target 12, and is then integrally fastened to the piles 32 driven into the water bottom 14. The anchoring part 34 is elongated orthogonal to the mooring direction of the mooring target 12 (refer to FIG. 3).

After the water bottom 14 is dug to embed the tilted support 33, the tilted support 33 is integrally coupled to the anchoring part 34 with the metal coupler 43. The tilted support 33 is then embedded.

The guide 51 is driven into the water bottom 14 on the extension of the mooring line 13 in the extending direction of the tilted support 33 in the anchor assembly 31. The holder 52 at the upper end of the guide 51 then receives the free end of the mooring line 13 fastened to the anchor assembly 31.

The water bottom 14 shown in FIG. 2 includes, as an upper layer, a topsoil layer 14*b* above a foundation ground 14*a*. The piles 32 in the anchor assembly 31 and the guide 51 are driven into the foundation ground 14*a*. The lower end of the tilted support 33, or the pressure receiving plate 41, is also placed to reach the foundation ground 14*a*.

Figure 7:
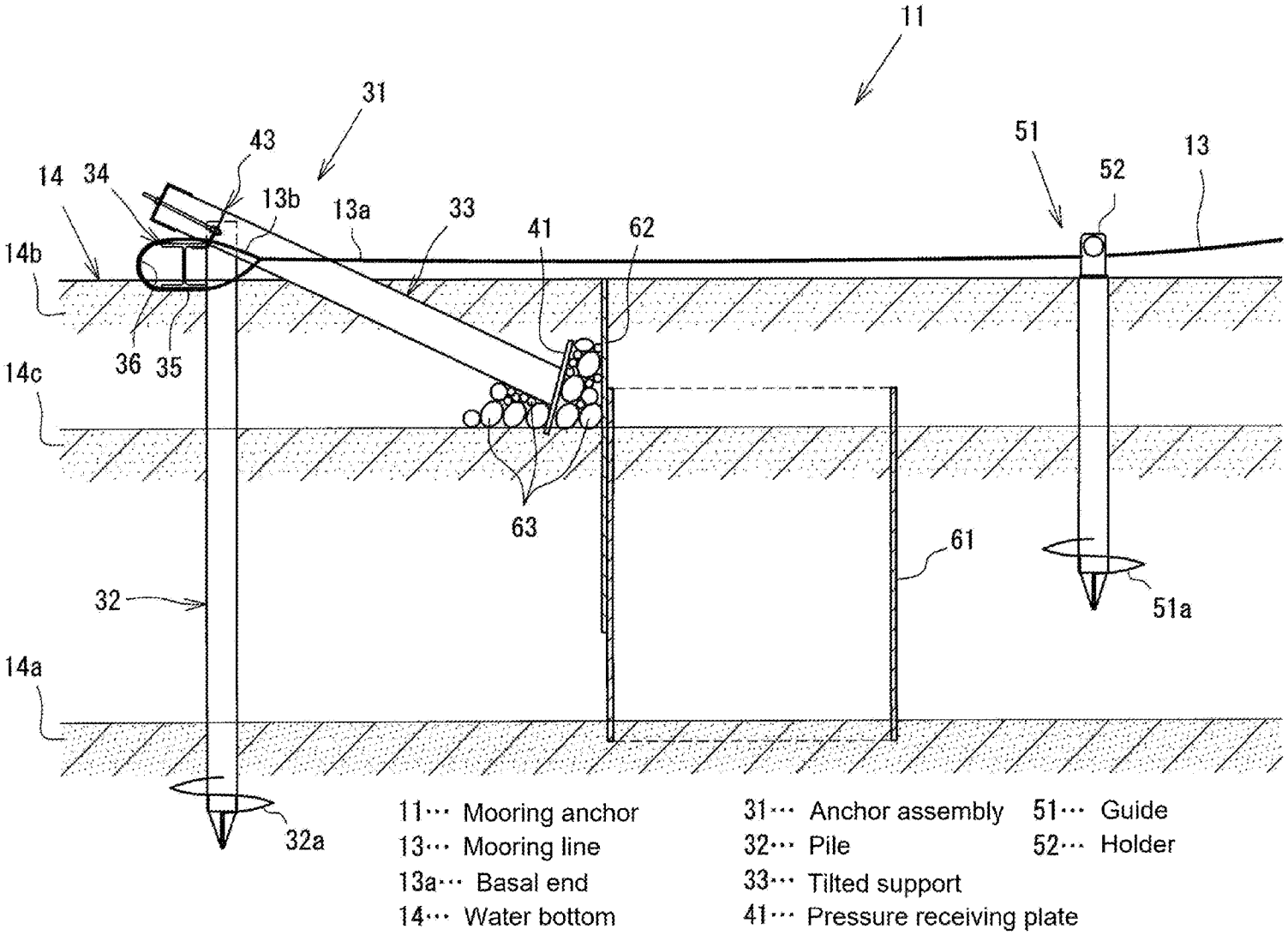
FIG. 7 is a side view of another example of a mooring anchor installed.

For a relatively soft cohesive soil layer 14*c* under the topsoil layer 14*b* at the water bottom 14, the foundation is consolidated as shown in FIG. 7. More specifically, the tilted support 33 has a consolidated foundation adjacent to its distal end. The consolidated foundation includes a buried member to be buried in the water bottom 14. More specifically, the consolidated foundation includes a hollow rectangular prism 61 as the buried member, a flat auxiliary plate 62, and riprap stones 63.

The hollow rectangular prism 61 is formed from metal and has a height greater than the thickness of the cohesive soil layer 14*c*. The hollow rectangular prism 61 is buried to extend perpendicularly from the foundation ground 14*a* to the topsoil layer 14*b*. The buried member, or the cylindrical hollow rectangular prism 61, is buried simply when driven, without the water bottom 14 being dug. The installation is thus easy. Also, the buried member, which is a hollow rectangular prism, is held in the water bottom 14 stably and firmly. The buried member may be of any shape other than a hollow rectangular prism.

The auxiliary plate 62 is formed from metal and extends from the cohesive soil layer 14*c* to the topsoil layer 14*b*. The auxiliary plate 62 extends perpendicularly from the cohesive soil layer 14*c* to the topsoil layer 14*b* along an outer surface of the hollow rectangular prism 61 adjacent to the anchor assembly 31. The hollow rectangular prism 61 is buried to extend from the foundation ground 14*a* to the topsoil layer 14*b*.

The riprap stones 63 are located around a corner defined by the surface of the cohesive soil layer 14*c* and the auxiliary plate 62 and adjacent to the anchor assembly 31, or specifically at the distal end of the tilted support 33.

In the mooring anchor 11 installed in the manner described above, the mooring line 13 extends from the anchor assembly 31 to the guide 51 along the water bottom 14 in a manner movable at the holder 52 in the guide 51 in the longitudinal direction. The mooring line 13 is movable in the horizontal direction as well at a position frontward from the holder 52.

When the mooring line 13 is pulled by the mooring target 12 that may move on the water surface with wind or may move due to the changing water level, the guide 51 changes a tensile force in the up-down (vertical) direction to be applied to the anchor assembly 31 through the mooring line 13 into a lateral tensile force, while retaining the mooring line 13 along the water bottom 14 in a movable manner.

The anchor assembly 31 remains installed with the piles 32 under a tensile force applied laterally through the mooring line 13. The tilted support 33 in the water bottom 14 prevents the piles 32 from being tilted or falling down.

Thus, the anchor assembly 31 can be installed firmly.

Also, the anchor assembly 31 includes the anchoring part 34 formed from H-beam steel, which is a heavy object, and the piles 32 fastened to the two ends of the anchoring part 34 in the longitudinal direction. The anchor assembly 31 can thus disperse applied gravity appropriately and have high tensile resistance.

The tilted support 33 includes the pressure receiving plate 41 on the distal end. A part of the tilted support 33 with the pressure receiving plate 41 is buried in the water bottom 14. This enables firmer installation.

The pressure receiving plate 41 is tilted with respect to the tilted support 33, and can stand in the manner described above when the tilted support 33 is tilted with respect to the horizontal direction. This structure appropriately disperses the tensile force received from the mooring line 13, enabling strong support.

Further, with the anchor assembly 31 and the guide 51 both driven into the water bottom 14 with piles, the workability is high. This enables relatively easy work underwater.

Another example of the present embodiment will now be described. The same components herein as those in the above structure are given the same reference numerals and will not be described in detail.

Figure 8:
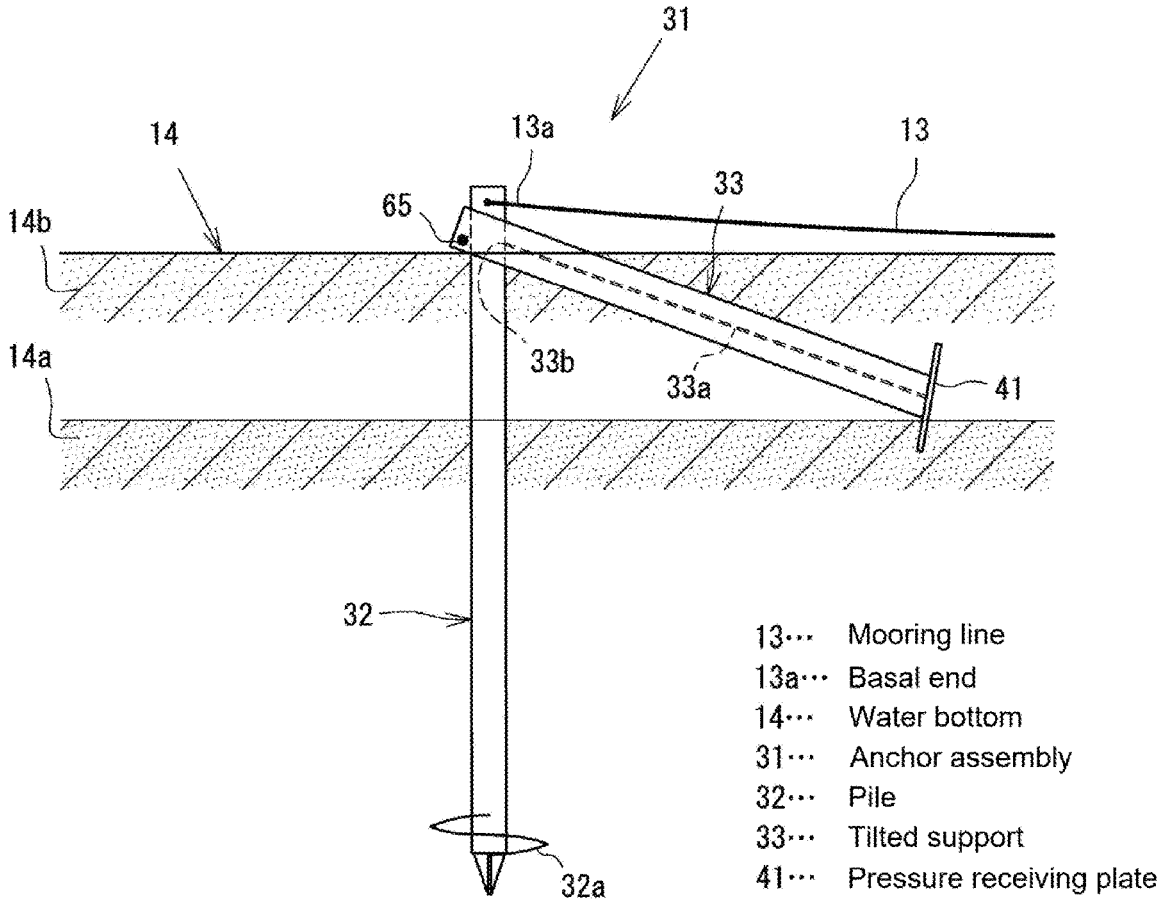
FIG. 8 is a side view of another example of an anchor assembly installed.

FIG. 8 is a view of an anchor assembly 31 in another example. The anchor assembly 31 includes a pile 32 having an upper end fastened to a basal end 13*a* of a mooring line 13. The mooring line 13 is placed through the pile 32 and fastened.

The tilted support 33 in the anchor assembly 31 is formed from H-beam steel as in the example described above. The tilted support 33 has a cutout 33*b* in a rear end of a web 33*a* of the steel H beam. The cutout 33*b* is large enough to receive the pile 32 in the rear end.

In the anchor assembly 31 described above, the pile 32 is driven into the water bottom 14, the tilted support 33 is tilted and driven into the water bottom 14, and the rear end of the tilted support 33 is fitted with the pile 32. This couples the tilted support 33 and the pile 32 together. The coupling may be performed by placing a bolt 65 through portions of the two flanges on the tilted support 33 that protrude outward from the pile 32.

When a mooring target 12 is small, the anchor may not have high tensile resistance and may have this simple structure.

REFERENCE SIGNS LIST

11 mooring anchor
13 mooring line
13*a* basal end
14 water bottom
31 anchor assembly
32 pile
33 tilted support
41 pressure receiving plate
51 guide
52 holder

The invention claimed is:

1. A mooring anchor for securing a basal end of a mooring line underwater, the mooring anchor comprising:

an anchor assembly to which the mooring line is to be fastened, the anchor assembly being installable at a water bottom; and a guide to be secured at the water bottom at a position away from the anchor assembly, the guide including a holder to receive and hold the mooring line in a movable manner, wherein the anchor assembly includes a pile drivable into the water bottom, and a tilted support extending obliquely downward toward the guide at the water bottom and to be embedded in the water bottom, and wherein the tilted support includes a pressure receiving plate being flanged on a distal end of the tilted support.

2. The mooring anchor according to claim 1, wherein the pressure receiving plate is tilted with respect to a longitudinal direction of the tilted support.

3. The mooring anchor according to claim 1, wherein the tilted support is tilted at an angle of 15 to 30 degrees with respect to a horizontal direction, and the pressure receiving plate is at an angle of 0 to 30 degrees with respect to a vertical direction.

4. The mooring anchor according to claim 1, wherein the guide includes a pile member drivable into the water bottom.

5. A mooring anchor for securing a basal end of a mooring line underwater, the mooring anchor comprising:

an anchor assembly to which the mooring line is to be fastened, the anchor assembly being installable at a water bottom; and a guide to be secured at the water bottom at a position away from the anchor assembly, the guide including a holder to receive and hold the mooring line in a movable manner, wherein the anchor assembly includes a pile drivable into the water bottom, and a tilted support extending obliquely downward toward the guide at the water bottom and to be embedded in the water bottom, wherein the mooring anchor further comprises a consolidated foundation adjacent to a distal end of the tilted support, and wherein the consolidated foundation includes a buried member to be buried in the water bottom.

* * * * *